US011229289B2

(12) United States Patent
Eckert et al.

(10) Patent No.: US 11,229,289 B2
(45) Date of Patent: Jan. 25, 2022

(54) FURNITURE PANEL

(71) Applicant: Bulthaup GMBH & CO. KG, Bodenkirchen (DE)

(72) Inventors: Marc Oliver Eckert, Bodenkirchen (DE); Andreas Ringwald, Landshut (DE); Gerhard Limmer, Frontenhausen (DE)

(73) Assignee: Bulthaup GMBH & CO. KG, Bodenkirchen (DE)

( * ) Notice: Subject to any disclaimer, the term of this patent is extended or adjusted under 35 U.S.C. 154(b) by 0 days.

(21) Appl. No.: 17/042,411

(22) PCT Filed: Mar. 27, 2019

(86) PCT No.: PCT/EP2019/057743
§ 371 (c)(1),
(2) Date: Sep. 28, 2020

(87) PCT Pub. No.: WO2019/185729
PCT Pub. Date: Oct. 3, 2019

(65) Prior Publication Data

US 2021/0076825 A1 Mar. 18, 2021

(30) Foreign Application Priority Data

Mar. 28, 2018 (DE) ..... 10 2018 107 419.0

(51) Int. Cl.
*A47B 96/20* (2006.01)
*E06B 5/00* (2006.01)

(52) U.S. Cl.
CPC ..... *A47B 96/205* (2013.01); *E06B 5/006* (2013.01); *A47B 2096/208* (2013.01)

(58) Field of Classification Search
CPC ..... A47B 96/205; A47B 2096/208; A47B 2096/209; E06B 5/006
See application file for complete search history.

(56) References Cited

U.S. PATENT DOCUMENTS

2003/0067254 A1* 4/2003 Manke ..... A47L 15/4265 312/204
2003/0091784 A1* 5/2003 Nykamp ..... A47B 96/206 428/99
2003/0170594 A1* 9/2003 Anderson ..... B44C 1/10 434/80

(Continued)

FOREIGN PATENT DOCUMENTS

DE 9105346 U1 6/1991
DE 19610678 A1 1/1997

OTHER PUBLICATIONS

English Translation of Foerst (DE19610678). (Year: 2021).*

(Continued)

*Primary Examiner* — Matthew W Ing
(74) *Attorney, Agent, or Firm* — Marshall, Gerstein & Borun LLP

(57) ABSTRACT

The disclosure relates to a furniture panel, in particular a furniture front, the panel having a carrier panel (T) and a cover (200). The cover has a space in which the carrier panel is accommodated, the space and the carrier panel being dimensioned such that the cover can be slipped over the carrier panel and fixed in its slipped-on position on the carrier panel by a force fit and/or form fit.

20 Claims, 2 Drawing Sheets

(56) References Cited

U.S. PATENT DOCUMENTS

| | | | | |
|---|---|---|---|---|
| 2005/0225216 | A1* | 10/2005 | Kim | A47B 96/201<br>312/204 |
| 2009/0126176 | A1* | 5/2009 | Kopf | B23P 11/00<br>29/243.5 |
| 2018/0172337 | A1* | 6/2018 | Choi | E06B 1/00 |
| 2019/0346610 | A1* | 11/2019 | Grzeskowiak, II | G09F 9/33 |
| 2020/0205569 | A1* | 7/2020 | Jones | A47B 96/18 |

OTHER PUBLICATIONS

International Application No. PCT/EP2019/057743, International Search Report, dated Jul. 4, 2019.
German Patent Application No. 10 2018 107 419.0, Search Report, dated Jul. 1, 2020.

* cited by examiner

FURNITURE PANEL

CROSS-REFERENCE TO RELATED APPLICATION

This application is a 35 U.S.C. § 371 National Stage of International Patent Application No. PCT/EP2019/057743, filed Mar. 27, 2019, which itself claims the benefit of and priority to German Application No. 10 2018 107 419.0, filed on Mar. 28, 2018, the content of each of which is incorporated by reference herein in its entirety and for all purposes.

The present invention relates to a furniture panel, in particular to a furniture front, wherein the furniture panel has a support panel and a cover.

It is known from the prior art, to provide a furniture front, e.g. a drawer, for example, with a cover such as a decor having a decor layer. A support panel of a wooden material can in this respect, for example, be provided with a plastic coating that gives the furniture front the final visual appearance.

A disadvantage with such furniture fronts comprises the fact that the decor cannot be changed or can only be changed with a great effort and that in another respect very great care is required in the installation so that the decor is not damaged.

It is the underlying object of the present invention to further develop a furniture panel of the initially named kind such that its visual appearance can be easily changed and the risk can additionally be precluded that the cover is damaged during the installation work.

This object is achieved by a furniture panel having the features of claim 1.

Provision is accordingly made that the cover has a space in which the support panel is at least partially received, with the space and the support panel being dimensioned such that the cover can be placed onto the support panel and is fixed on the support panel in its placed on position by force fit and/or by form fit.

The cover is thus releasably connected to the support panel so that it can be easily installed and dismantled. Apart from this, there is an advantage in that the installation of the cover can take place when other work on the piece of furniture has been concluded so that the cover is protected against damage that could otherwise occur at the piece of furniture during the installation work.

It is pointed out at this point that the term "panel" is not to be interpreted restrictively such that it has to be a flat, planar component. Materials or supports that are also curved, shaped in any form, and of any thickness are covered by the invention and by the term "panel". The term "support panel" is thus synonymous with the term "support".

The furniture panel can, for example, be the front of a drawer, a furniture door, a door of a kitchen appliance such as a fridge/freezer, a side of a piece of furniture, etc.

Provision is preferably made that the cover is only held on the support panel by force fit, i.e. by friction fit, that is, that no further fastening means are required.

The cover can in turn have a support material such as a metal sheet, plastic, wood, etc. that is partially or completely covered by or provided with a covering.

The support material is preferably polygonal, preferably quadrangular, and has a projecting edge that can be chamfered at every side The covering preferably covers the support material such that the support material is no longer visible or is only partially visible, e.g. only with a step-like projection, on the support panel in the placed on state of the cover. The support material in this case is largely or completely covered by the covering. The inner side of the support material is visible when the cover has been removed. The support material can e.g. comprise sheet metal.

The cover or the covering can partially or completely comprise leather and/or a textile material and/or plastic and/or a film and/or paper or can consist of one or more of these materials. It is particularly preferred if the leather is natural leather.

A particularly good adhesion of the covering to the support material that is easy and simple to implement results when the covering is partially or completely adhesively bonded to the support material.

The support panel, that preferably consists of or comprises wood, preferably comprises a step-like section on which the edge ends of the cover sit, with provision preferably being made that that the step-like section and the cover terminate with one another at one or more sides. A flush transition between the outer side of the cover and the step-like section results in this case.

The support panel is preferably quadrangular.

The support panel preferably has one or more through-holes or bores so that the cover can be pressed away from the support panel from the inside through the through-holes. The cover can be pressed away from the support plate and then removed by pressure on the side of the cover facing inward.

Provision can furthermore be made that the support panel has one or more fittings such as hinges, guides, etc. that are located on the side of the support panel remote from the cover.

Said through-hole can serve the reception of the fitting or fittings or of a part thereof.

The cover preferably does not have any visible seams or any seams at all in the state placed onto the support panel.

The present invention further relates to a method of installing a furniture panel, in particular a furniture front, in accordance with one of the claims 1 to 9, with the support panel being installed first and then, preferably as the last workstep in the installation or manufacture of the piece of furniture in question, the cover being placed onto the support panel.

It is thus prevented that the cover becomes dirty or is damaged as part of the installation process.

The present invention further relates to at least one piece of furniture such as a drawer, a cupboard, etc. having at least one furniture panel in accordance with the invention.

It is pointed out at this point that the terms "a" and "one" do not necessarily refer to exactly one of the elements, even though this represents a possible embodiment, but can also designate a plurality of elements. The use of the plural equally also includes the presence of the element in question in the singular and, conversely, the singular also includes a plurality of the elements in question.

Further details and advantages of the invention will be explained in more detail with reference to an embodiment shown in the drawing.

There are shown:

FIG. 1: a schematic view of the worksteps in the manufacture of the cover;

FIG. 2: a perspective view of the corner region of a support panel;

FIG. 3: perspective views of the corner region of a support panel with through-holes without a hinge, with a hinge, and with a cover before its placing on; and FIG. 4: perspective views of the corner region of a cover and of a furniture panel with different materials of the cover.

FIG. 1 shows in Step 1 a sheet metal plate 100 from which individual sheet metal blanks 10 are cut out by e.g. laser.

The steps are each marked by numbers above the Figures.

Such a sheet metal blank 10 is shown in Step 2. It has a polygonal, preferably quadrangular, shape (dashed lines), at whose sides a respected edge region K projects. The sheet metal blank 10 forms the support panel 10.

The support material 10 is lined over the full surface with a textile or with leather or with another covering B on one side in Step 3.

A stamp S is then positioned in the corner regions of the covering in Step 4 and a corner of the covering is punched out, as can be seen in Step 5.

Subsequently, the projecting edges of the covering B are draped over the support material 10, as can be seen from Step 5 (see arrows) and the edges K of the support material 10 are consecutively (1, 2, . . . ) or simultaneously chamfered, as is shown in Step 6. These edges K are preferably subsequently perpendicular to the base surface of the support material, i.e. perpendicular to the plane of the paper.

On chamfering, the covering is draped inward at the corners (see arrow), i.e. toward the support material. The outer side of the cover disposed at the bottom in Steps 1 to 7 is now completely covered by the covering.

If the cover is now turned over starting from the position in accordance with Step 7, the cover 200 in accordance with Step 8 is obtained, i.e. a box-like body having an open side that is arranged at the bottom in Step 8.

Figure 1:
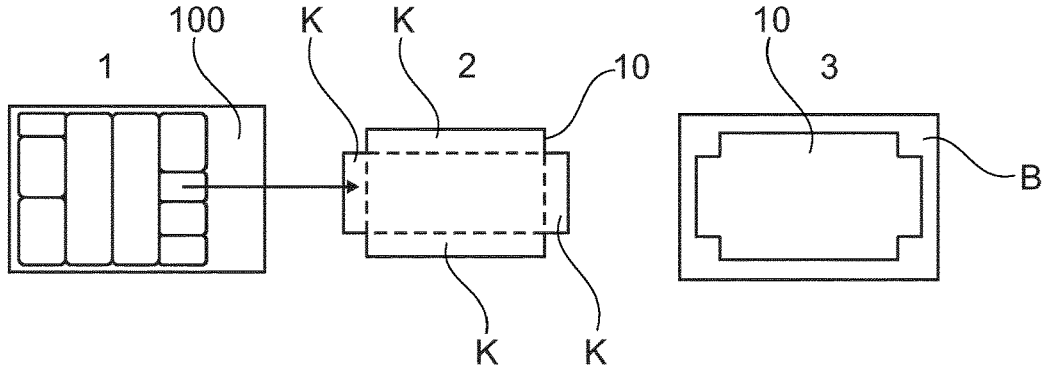
Figure 2:
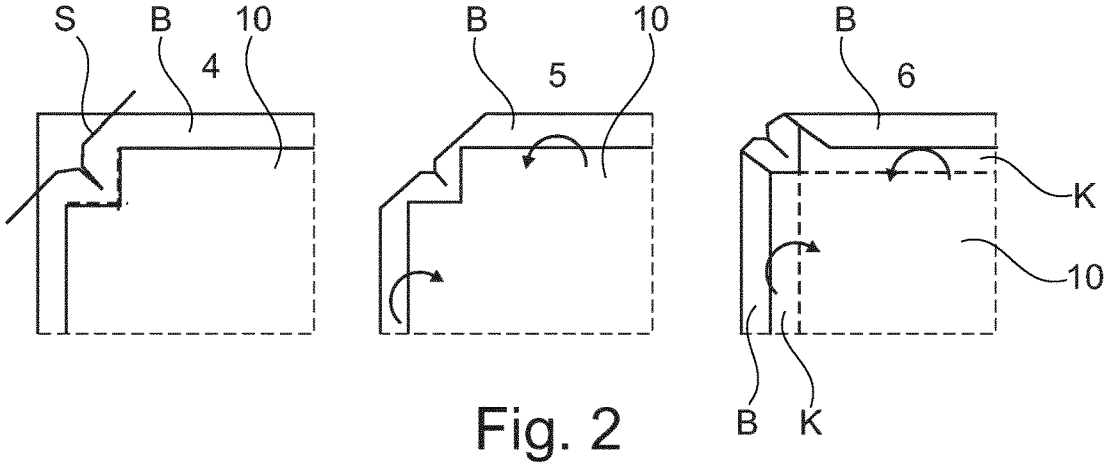
FIG. 2 shows the support plate T with a chamfer or with a step-like projection S.
Figure 3:
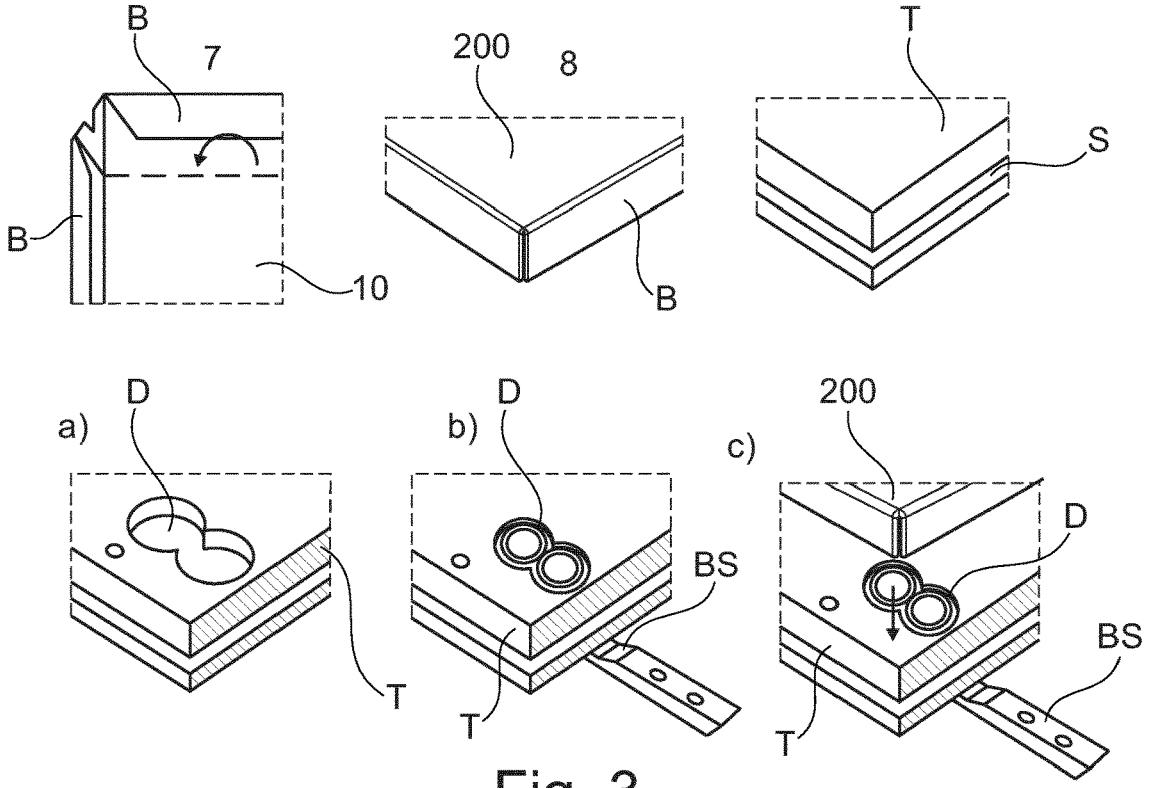
FIG. 3 shows the through-holes D of the support panel T without fittings (a), with hinge holders received therein (b) at which the hinge BS is located, and briefly before the placing on of the cover 200, as can be seen from FIG. 3*c*).
Figure 4:
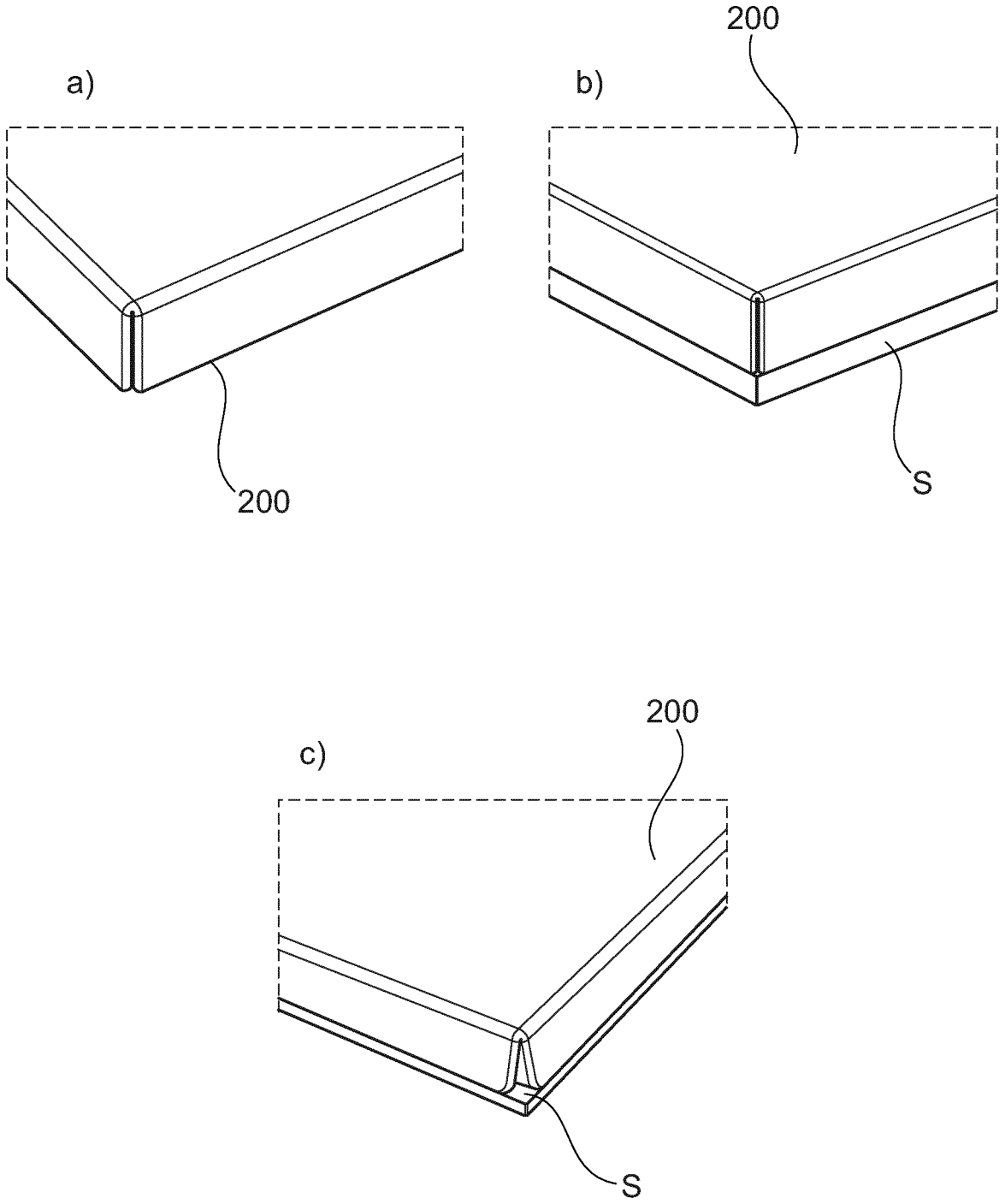

A cover 200 having a textile outer side without a support panel can be seen from FIG. 4*a*). FIG. 4*b*) shows the cover 200 in the state placed onto the support panel T, with the cover having a textile on its visible outer side.

FIG. 4*c*) shoes the arrangement in accordance with FIG. 4*b*) with a cover whose outer side consists of natural leather.

In a preferred embodiment, the present invention has one or more of the following advantages:

1. Single-side leather/textile lining possible without deformation of the components by floating support of the cover on the support panel;
2. Industrial adhesion process of the front sides possible;
3. Textile seam appearance without seams;
4. Modular system: Free combination of the materials of the support and cover;
5. Variation is only produced right at the end of the manufacturing process;
6. 2-shell design; thereby visual "lightness";
7. Subsequent replacement of the covers possible;
8. All the technology (hinges, touch fitting, buffers, etc.) is done in a known material on the rear side, i.e. on the side of the support plate remove from the cover;
9. Cover is only applied right at the end of the manufacturing process; the risk of damage/contamination is thereby reduced;
10. Own production and external purchase of the covers possible;
11. No open edges at the covering, e.g. at the leather or textile;
12. Support can be completely sealed so that protection against moisture can also be achieved;
13. The most varied materials can be processed such as leather, textile, paper, films, etc.

The invention claimed is:

1. A furniture panel, wherein the panel has a support panel and a cover, wherein the cover has a space in which the support panel is at least partially received, with the space and the support panel being dimensioned such that the cover can be placed onto the support panel and is fixed on the support panel in a placed on position by force fit and/or by form fit, wherein the support panel has one or more through-holes so that the cover can be pressed away from the support panel through the through-holes.

2. The furniture panel in accordance with claim 1, wherein the cover in turn has a support material that is provided with a covering.

3. The furniture panel in accordance with claim 2, wherein the covering is adhesively bonded to the support material.

4. The furniture panel in accordance with claim 1, wherein the cover or a covering completely and/or partially comprises leather and/or a textile material and/or plastic and/or a film and/or paper.

5. The furniture panel in accordance with claim 1, wherein the support panel has a step-like section on which the cover is seated, the step-like section and the cover terminate with one another at one or more sides.

6. The furniture panel in accordance with claim 1, wherein the support panel has one or more fittings that are located on the side of the furniture panel remote from the cover.

7. The furniture panel in accordance with claim 1, wherein the fitting or fittings are arranged in said through-hole or through-holes.

8. The furniture panel in accordance with claim 1, wherein the cover does not have any visible seams or any seams at all in the placed on state.

9. The method of installing a furniture panel in accordance with claim 1, wherein the support panel is installed first and then the cover is placed onto the support panel.

10. A piece of furniture, comprising at least one furniture panel in accordance with claim 1.

11. The piece of furniture of claim 10, wherein the piece of furniture comprises a cupboard or a drawer.

12. The furniture panel in accordance with claim 1, wherein the cover in turn has a support material that is provided with a covering and the cover or the covering completely and/or partially comprises leather and/or a textile material and/or plastic and/or a film and/or paper.

13. The furniture panel in accordance with claim 12, wherein the covering is adhesively bonded to the support material.

14. The furniture panel in accordance with claim 13, wherein the support panel has a step-like section on which the cover is seated, the step-like section and the cover terminate with one another at one or more sides.

15. The furniture panel in accordance with claim 14, wherein the support panel has one or more fittings that are located on the side of the furniture panel remote from the cover.

16. The furniture panel in accordance with claim 15, wherein the fitting or fittings are arranged in said through-hole or through-holes.

17. The furniture panel in accordance with claim 16, wherein the cover does not have any visible seams or any seams at all in the placed on state.

18. The furniture panel in accordance with claim 1, wherein the support panel has a step-like section on which the cover is seated, the step-like section and the cover terminate with one another at one or more sides and the support panel has one or more through-holes so that the cover can be pressed away from the support panel through the through-holes.

19. The furniture panel in accordance with claim 18, wherein the support panel has one or more fittings that are located on the side of the furniture panel remote from the cover.

20. The furniture panel in accordance with claim 1, wherein the furniture panel comprises a furniture front.

* * * * *